US006270327B1

(12) United States Patent
Wolz et al.

(10) Patent No.: US 6,270,327 B1
(45) Date of Patent: Aug. 7, 2001

(54) PNEUMATIC HAND PUMP

(76) Inventors: Darren L. Wolz, 887 E. 800 S.; Kennen L. Cluff, 1420 E. 900 S.; Troy H. Manwill, 902 E. 800 S., all of Springville, UT (US) 84663

( * ) Notice: Subject to any disclaimer, the term of this patent is extended or adjusted under 35 U.S.C. 154(b) by 0 days.

(21) Appl. No.: 09/237,324

(22) Filed: Jan. 25, 1999

Related U.S. Application Data

(60) Provisional application No. 60/072,554, filed on Jan. 26, 1998.

(51) Int. Cl.[7] ..... F04B 39/10
(52) U.S. Cl. ..... 417/547; 92/58.1
(58) Field of Search ..... 417/547, 437, 417/545, 552, 234; 92/58.1

(56) References Cited

U.S. PATENT DOCUMENTS 3,549,015 * 12/1970 Willinger ..... 210/416
3,981,625 * 9/1976 Wickenburg ..... 417/63
5,127,804 * 7/1992 Chappell ..... 417/231
5,433,136 7/1995 Lung-Po .
5,494,410 * 2/1996 Maier-Laxhuber et al. ..... 417/53
5,494,411 * 2/1996 Chuang ..... 417/234
5,690,016 11/1997 Hwang .

* cited by examiner

*Primary Examiner*—Timothy S. Thorpe
*Assistant Examiner*—Ehud Gartenberg
(74) *Attorney, Agent, or Firm*—Knobbe, Martens Olson and Bear, LLP

(57) ABSTRACT

A hand pump has a tubular pump housing with a longitudinal axis. A piston with a peripheral seal reciprocates along the axis to compress air against a sealed end of the housing. A tubular plunger nested in the housing connects to the piston to reciprocate the piston and compress the air. A flexible hose is placed in fluid communication with the compressed air. The hose is coiled to fit entirely within the tubular plunger during storage. A removable handle is inserted through a distal end of the plunger to make it easier to reciprocate the plunger. The handle, tire repair tools and materials, and other items can be placed inside the plunger for storage, and enclosed by placing an end cap on the pump housing.

15 Claims, 4 Drawing Sheets

PNEUMATIC HAND PUMP

This application is a continuation of Provisional application 06/072,554 filed Jan. 26, 1998.

FIELD OF THE INVENTION

This invention relates to pneumatic hand pumps for inflating tires and other items.

BACKGROUND OF THE INVENTION

When a tire goes flat the tire is removed from the rim and the hole in the tire or inner tube is located. Sometimes a hole in a tubeless tire does not require removal of the tire from the rim. If a tubeless tire is used, the hole in the tire is rasped and then a plug coated with an adhesive is inserted by a eye repair needle to seal the hole. If a tube is used, a patch coated with an adhesive is placed over the hole in the tube. The tire is then reassembled and re-inflated. If a flat needs to be repaired in a remote area, the tools must be portable and a hand pump must be used instead of an electric air compressor to re-inflate the tire Vehicles such as bicycles, motorcycles and all terrain vehicles (ATV's) use inflated tires that sometimes go flat in remote areas where a tire repair kit would be useful, if not essential. But tire repair tools are large and heavy, and such vehicles either do not have the room for a tire pump and tire repair tools and materials, or the weight for conventional tools and pumps is undesirable. Further, the tools, pump and repair materials are often separated so that one or more needed parts is missing or has become damaged. This is particularly so with the pump because typically a flexible extension hose extends from the base of the pressurizing cylinder. The hose carries the pressurized air from the pump to the tire. The flexible hose is often snagged and cut or abraded. The hose also snags or catches on other items. All these disadvantages make it undesirable to carry such pumps. There is thus a need for a pump avoiding these disadvantages.

Some small hand pumps have been developed for bicycles. But such pumps have a small diameter and short length cylinder to reduce weight, and thus they compress very little air with each actuation of the pump. The low volume pump may be usable for bicycle tires because the tires are small and require little air. But larger tires require much pumping which is very tiring. To make matters worse, a person typically holds one end of these bicycle pumps with one hand and pumps with the other hand, effectively pushing the hands toward each other. This is very tiring, especially compared to normal hand-pumps where one end of the pump rests against the ground and a person's weight can be placed on the pump handle to urge the handle toward the ground and compress the air.

There is thus a need for a more compact, lightweight hand pump and associated means to repair a flat tire.

SUMMARY OF THE INVENTION

This invention provides a compact, light weight pump that can hold a repair kit or other items. A tubular plunger is nested inside a tubular housing. A reciprocating seal is connected to an interior end of the plunger to compress air in one end of the housing. An extension hose is coiled inside the plunger to save space. A removable handle can be placed inside the plunger for storage to also reduce space. An end cap can be removably fastened to the housing to seal the interior and any stored parts, including the hose, handle, and any tire repair tools or materials that are desired. There is thus provided a light weight, compact storage for a hand pump and tire repair kit.

In more detail, the hand pump comprises a tubular, cylindrical housing into which is placed a sliding seal to compress air between the seal and a sealed end of the housing as the seal moves toward the sealed end of the housing. A plunger is nested inside the housing. The plunger has an interior end connected to the sliding seal to reciprocate the seal in the housing and compress the air. An interior end of an extension hose is placed in sealed fluid communication with the compressed air when the hose is in use and during storage. The hose has a distal end from which the compressed air exits. The hose is placed entirely inside the housing when not in use. A rod is removably connected to the distal end of the plunger to provide a handle to help actuate the plunger and pump the air. Advantageously the rod extends through holes in a distal end of the plunger. An end cap is removably connected to the distal end of the housing to enclose the housing with the hose inside the housing.

Tire repair items can be stored inside the plunger when the end cap is fastened to the housing. The sealed container protects the hose, tire repair items and any other stored items from weather and corrosive elements. The housing can be made of PVC, ABS or other engineered plastics, for light weight and durability.

There is thus provided a light weight, compact hand pump that can store various items, including tire repair items. Yet the size and diameter of the pump can be made large enough to provide relatively large amounts of compressed air for each stroke of the pump.

BRIEF DESCRIPTION OF THE DRAWINGS

These and other advantages will be better understood in view of the following drawings, in which like numbers refer to like parts throughout the description.

DETAILED DESCRIPTION OF THE PREFERRED EMBODIMENT

Figure 1:
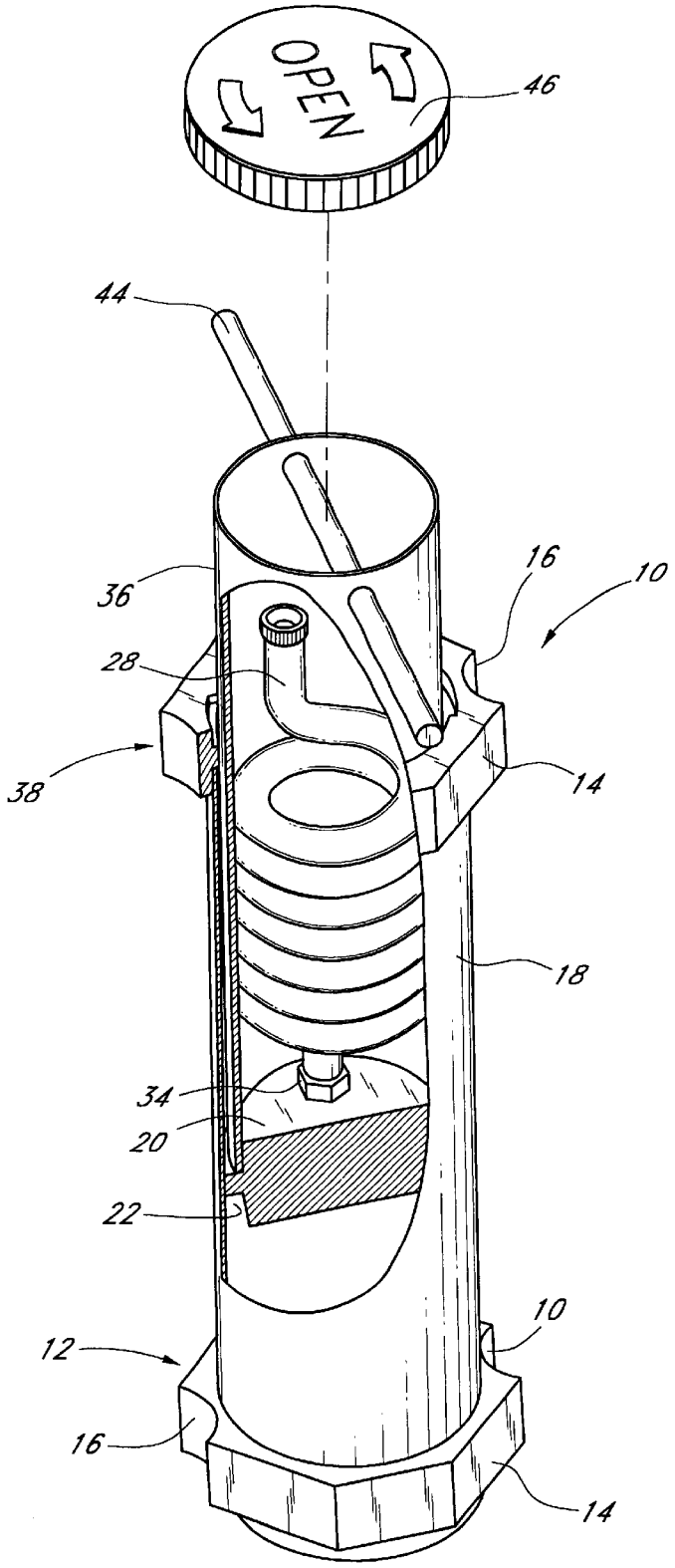
FIG. 1 is a partial cut-away, perspective view showing the tire pump of this invention.
Figure 2:
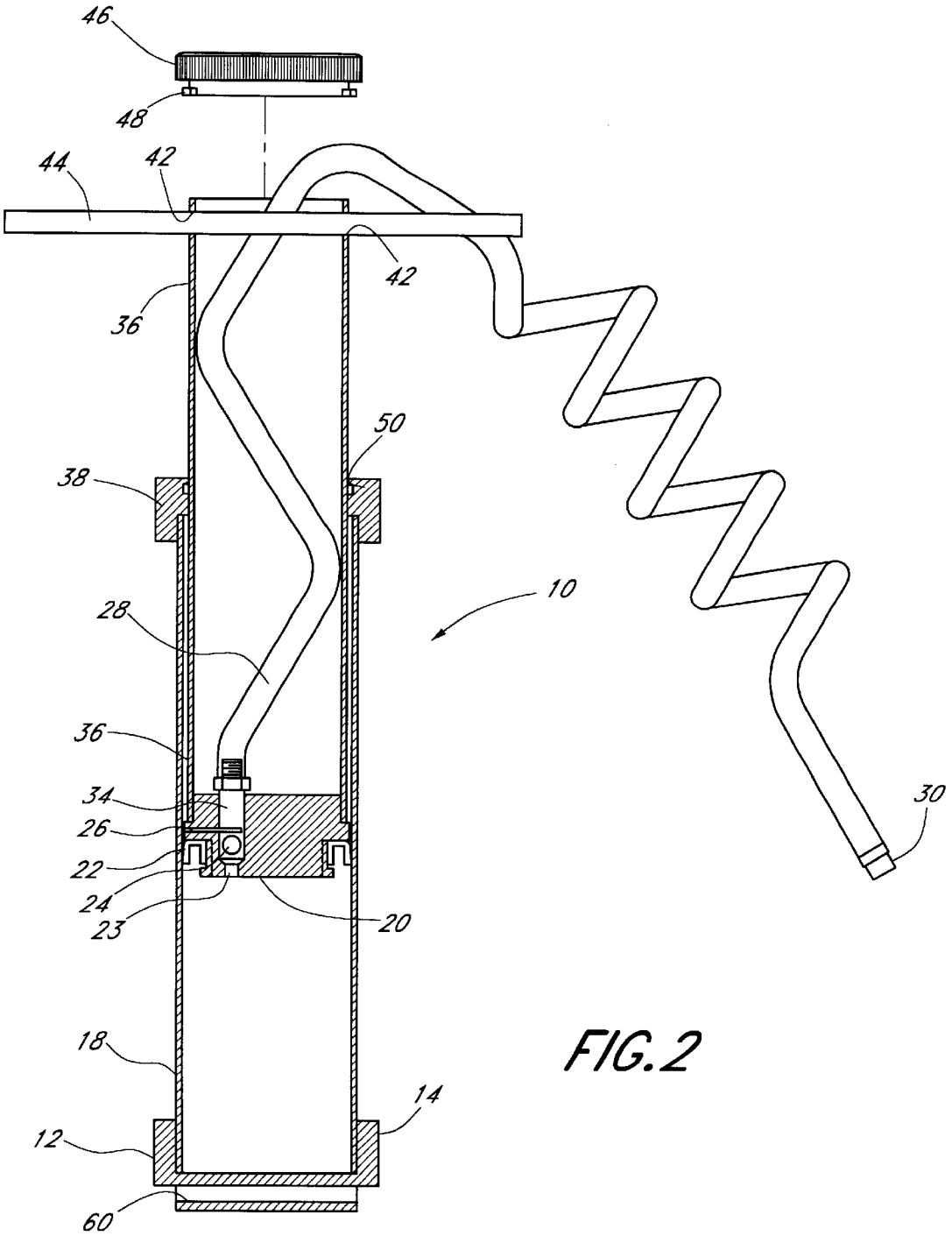
FIG. 2 is a sectional view of the pump of FIG. 1 in mid-stroke.
Figure 3:
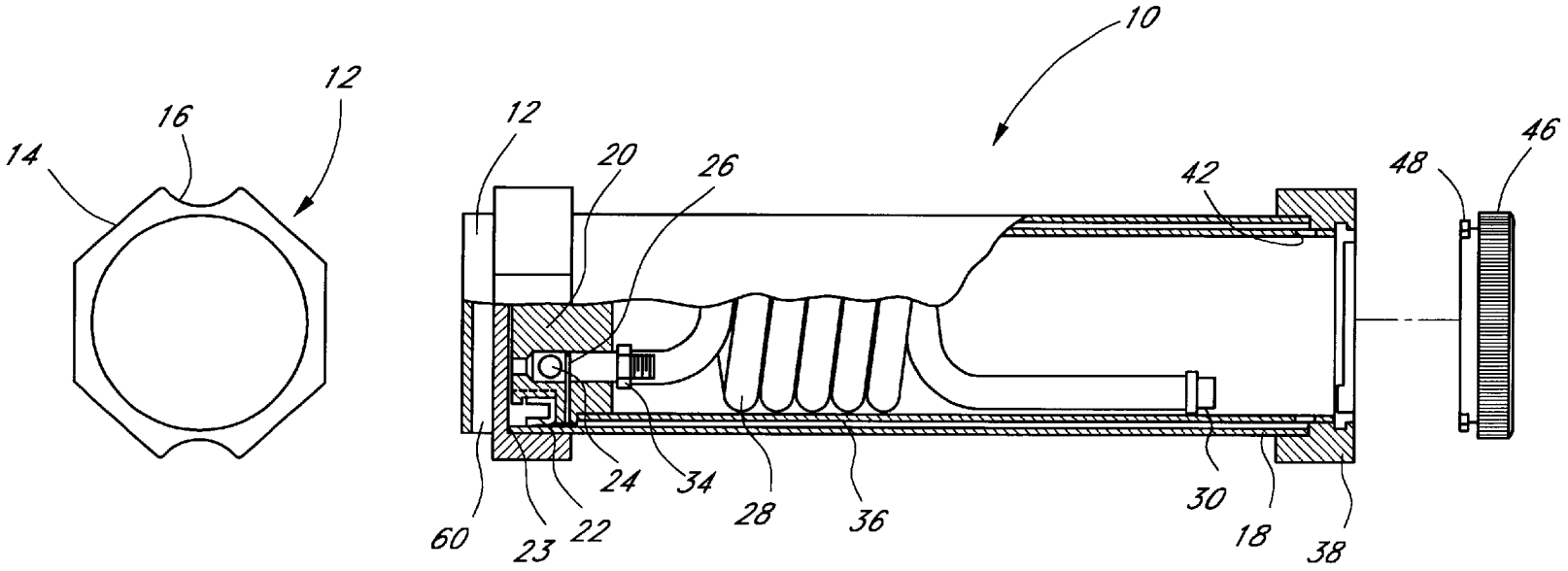
FIG. 3 is an exploded, sectional view of the pump of FIG. 1.

Referring to FIGS. 1 and 2, the tire pump 10 comprises a cup-shaped base 12 that advantageously has opposing flats 14 and recesses 16 on its exterior sides to facilitate clamping the pump to a cylindrical object such as an ATV rack, handlebars, frame section, etc. Connected to and extending from the base 12 is a tubular housing 18. The housing 18 is advantageously a cylindrical tube having a smooth interior surface. A sliding piston 20 fits within the housing 18 and is configured to slide along a longitudinal axis of the tubular housing 18. A resilient seal 22 is interposed between the piston and the housing 18 to compress air in the housing.

Various seals can be used, but preferably the seal is achieved by forming a recess around the periphery of the piston 20, with the recess opening onto the end of the piston 20 that faces the base 12. A U-shaped, resilient seal 22 is placed into this recess. The U-shaped cup-seal 22 thus extends around the periphery of the piston 20 and is interposed between the piston 20 and the inside of the housing 18. The open end of the U-shaped seal 22 faces the base 12 so that as the piston 20 and seal 22 move away from base 12 air passes between the seal 22 and the inside walls of the housing 18. But when the seal 22 and piston 20 move toward the base 12 the outer portion of the U-shaped seal is urged against the interior walls of the housing 18 to form an air-tight, sliding seal which compresses the air in the housing 18 between the piston 20 and the base 12. The seal 22 is advantageously made of rubber or a low durometer elastomer.

A hole 23 is placed through the piston 20 to allow the compressed air to escape. The hole 23 advantageously extends generally parallel to a longitudinal axis of the housing 18 along which the piston 20 and seal 22 move to compress the air. Advantageously, a check valve 24 is placed into this hole 23 and held in position by known means, such as a pin 26. The check valve allows compressed air to flow out of the valve and out of the variable volume chamber formed between the piston 20 and the base 12, but not into the chamber between the piston 20 and base 12. As illustrated, the check valve 24 is a simple ball check valve, but other check valves can be used.

A flexible air-hose 28 is in fluid communication with the hole 23 to convey the compressed air to a vehicle tire or other item to be inflated. Advantageously the hose 28 is coiled inside the plunger 36 abutting the interior wall of the plunger 36, although the hose 28 could be coiled around the outside of the plunger 36 and inside the housing 18. The plunger 36 is described later. The hose 28 preferably does not extend beyond the distal end of the plunger 36 and/or the housing 18 when the hose 28 is in the stowed configuration. The distal end of the hose 28 can be grabbed and pulled out of the plunger 36 and housing 18 for use. Advantageously, the hose 28 has sufficient physical memory that it re-coils inside the plunger 36 after use. The hose may advantageously be made of polyurethane.

The distal end of the flexible hose 28 has a connection fitting 30 configured for connection to the desired object to be inflated, such as the threads of a valve stem. To make the connection to the pump 10 easier, a threaded fitting 34 can be placed in the hole 23 with the threads on the side of the piston opposite the base 12. A mating threaded fitting on the end of the hose 28 that is connected to the pump 10 can thus be screwed onto the fitting 34 to form the gas-tight connection.

The side of the piston 20 opposite the base 12 is connected to a plunger 36 that is used to slide the piston 20 and seal 20 along the length of housing 18 in order to pump the air. The plunger 36 can take various forms, including the central rod common in many hand pumps. But preferably the plunger 36 comprises a cylindrical tube coaxial with, and slightly smaller in diameter than, the housing 18. In particular, the piston 20 has a recess around its periphery into which an interior end of the cylindrical plunger 36 extends. The plunger 36 can be threaded into mating threads on piston 20, or glued, or mechanically fastened, or connected by other means. The housing 18 thus forms an outer cylinder with a coaxial, inner cylinder 18 formed by the plunger 36.

At the end of the housing 18 opposite the base 12 is mounted an end fitting 38. The end fitting 38 is an annular structure that extends around the outside of the end of the housing 18 to strengthen the housing. It can be threaded onto the outside of the housing 18, glued or fastened by a variety of other means. The exterior of end fitting 38 advantageously has flats 14 and recesses 16 (FIG. 1) corresponding to those in the base 12. The recesses 16 are advantageously a segment of a circle and allow placement over a tube of a motor vehicle to help hold the pump 10 during storage in the vehicle. The end fitting 38 also has a central hole through which plunger 36 slidingly extends. Optionally, an O-ring seal (not shown) can be interposed between the inside of the end fitting 38 and the outside of the plunger 36 to form a redundant seal. The end fitting 38 extends inside the housing 18 to provide a motion stop that limits the piston 20 from being pulled out of housing 18.

The distal end of the plunger 36 has two aligned holes 42, one in each opposing side of the plunger. The holes 42 are sized to allow a handle 40 to be removably placed through the distal end of the plunger 36. The handle 40 is large enough and long enough to act as a handle to move the plunger 36 and compress the air in the pump 10. A suitable handle 40 is believed to be a metal rod, preferably steel, about 0.25 inches in diameter and about 7 inches long.

The bases 12 and housing 18 form a gas-tight tube. As the piston 20 and seal 20 slidingly reciprocate along the length of the housing 18, air enters the chamber between the piston 20 and base 12 and is compressed as the plunger moves toward the base 12. The compressed air exits the check valve 24 and passes through the tube 28 via end fitting 30. The handle 44 is used to manually reciprocate the plunger 36 to compress the air in the pump 10.

Preferably, the length of the plunger 36 relative to the housing 18 is such the plunger 18 can be urged toward base 12 so that its distal end with the holes 42 does not extend beyond the end fitting 38. If so, then a removable cap 46 can cover the hole in the end fitting 38. Advantageously, threads or a bayonet mount 48 cooperate with corresponding threads or recesses 50 (FIG. 2) in the end fitting 38 to removably fasten the cap 46 to the end fitting 38, and hence to the housing 18.

Figure 4:
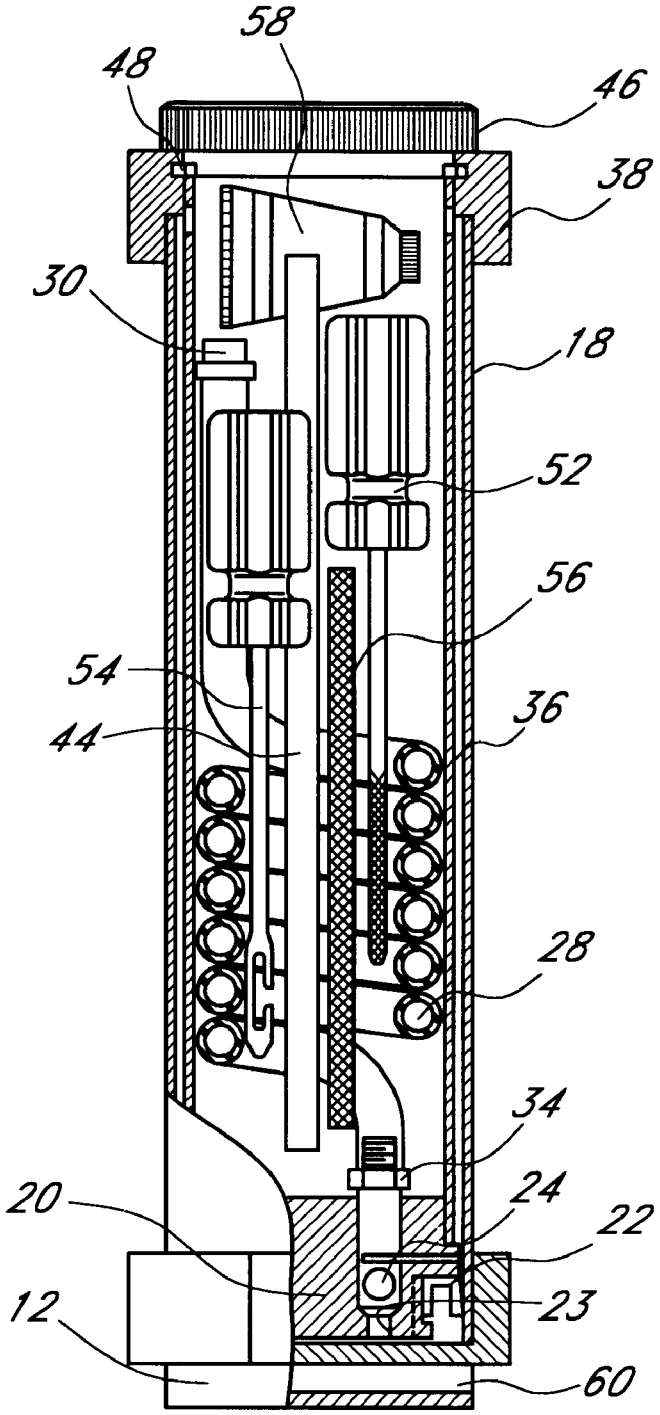
FIG. 4 is a sectional view of a tire repair kit in a stored configuration and using the pump of FIG. 1.

Referring to FIG. 4, there is shown a stowed configuration of the pump 10. The piston 20 abuts, or is placed adjacent to the base 12, with the flexible tube 28 coiled inside the housing 18 and plunger 36. The end cap 46 is fastened to end fitting 38 to form a closed container. Advantageously the end cap 46 provides a fluid tight seal so no water can enter the inside of the pump 10.

Inside the housing 18, and preferably inside the plunger 36, are placed various items, such as handle 40. The items can also include various tools to repair holes in deflated items such as tires, inflated floating items, or other inflated items. For vehicle tires, such tools include a rasp 52, an eye repair needle 54, patches and/or plugs 56, and a tube of adhesive 58. The rasp 52 is use to clean a hole in a tire that is to be repaired. The eye repair needle 54 can insert plugs 56 into the hole in the tire to seal the tire. Patches can be used to patch a hole in an inner-tube. The adhesive fastens the patch or plug to the tire. Other items or valuables, as desired, can be placed in the plunger 36 and/or housing 18.

For use, the cap 46 is removed. The handle 40, rasp 52, needle 54, patches and/or plugs 56, and tube 58 can be removed. The distal end of the hose 28 is grabbed and pulled out so the fitting 30 on the distal end of flexible hose 28 can be fastened to the valve stem or item to be inflated. Because the interior end of the hose 28 is connected to the piston 20, pulling on the hose 28 pulls the piston 20 and plunger 36 out of the housing 18 and that makes it easy to access the inside of the plunger 18 and remove any items not previously removed. Alternatively, the user can reach inside and pull the plunger 18 up and out of its nested position in the housing 18. The handle or rod 40 is inserted into holes 44 in the distal end of the plunger 36. The base 12 is placed against the ground, and the handle 40 used to reciprocate the plunger 36 to pump air through the hose 28. If desired, a second rod 40 can be inserted through a hole 60 in the base 12 generally orthogonal to the longitudinal axis of housing 18, in order to form a foot holder against which a person's foot can be placed to hold the pump 10 as the plunger 36 is being withdrawn from the housing 18. After use, the parts can be restored inside the plunger 36 and/or housing 18, and the cap 46 placed on the end fitting 38 to reseal the pump 10.

The housing 18 may be made of metal or various engineered plastic materials (e.g., PVC, ABS, and the like), but is preferably of PVC to reduce weight. A length of about 10 inches and a diameter of about 2 inches is believed suitable for housing 18, with the base 12 and end cap 38 having a length along the longitudinal axis of the pump 10 of about 1 inch. Other dimensions are possible, depending on the particular needs. But the described dimensions and arrangements provide a relatively large volume of compressed air and sufficient storage space for tools large enough to be gripped and used easily.

By placing the coiled hose 28 inside the pump 10, a very compact pump is achieved. Further, the flexible hose 28 is not exposed to damage and puncture which would cause loss of air pressure to the tire. Additionally, by placing the hose 28 inside the pump 10 it is not free to snag other objects. The arrangement also allows a good, air-tight connection between the hose 28 and the pump 10. The removable end cap and the coaxial-arrangement of the tubular plunger and the tubular housing also allows the body 18 of the pump 10 to be used for storage of various items, including the tire repair tools likely to be needed, first aid items, or other items as desired. This storage prevents the tools from being separated from the pump and lost. The water-tight seal by end cap 46 prevents corrosion of the metal tools or other degradation of the items stored in the pump 10.

The placement of the tools with their longitudinal axis aligned with the longitudinal axis of the pump 10, as shown in FIG. 4, provides for compact storage. Advantageously the tool handles have longitudinal slots on the exterior surface to not only increase gripping of the handle, but to allow storage of tubular items such as plugs or rods. Further, by placing the shaft of one tool adjacent the handle of an adjacent tool, the shafts can be nestled into the slots in the handles of the other tool, thus further saving space. Placing the tools and materials inside the coiled hose 28 also helps avoid noise associated with having metal tools rattle around in a container.

The above disclosure and description is given by way of example, not limitation. Thus, given the above disclosure, other variations that use the spirit of the invention disclosed herein will be apparent to those skilled in this area. Further, the above description uses the various features in combination, but it is to be understood that each of the described features can be used separately from the others, or can be used in combination with one or more of the features described herein.

What is claimed is:

1. A pneumatic hand pump capable of providing a relatively large volume of air during a single stroke for inflating an All Terrain Vehicle tire, comprising:

a cylindrical, tubular pump housing having a diameter of about two inches, a longitudinal axis with a length of about ten inches, and a base at one end of the pump housing;

a piston sized to reciprocate along the axis;

a seal interposed between the piston and the housing to seal the piston against the housing and to form a variable volume chamber to compress air in the chamber as the piston moves toward the base;

a plunger having a distal end comprising a piston, said plunger and piston adapted to slidably reciprocate in the pump housing, the plunger being slightly less than 2 inches in diameter and slightly less than 10 inches in length to create a storage space therein; and a coiled flexible hose having a front end connected to the piston inside the housing and placed in fluid communication with the variable volume chamber, the hose having an opposing second end placeable outside the housing, the hose being coiled to fit entirely within the plunger when in a stored configuration, said hose having sufficient physical memory that it recoils inside the plunger after use.

2. A pump as defined in claim 1, further comprising a handle removably connected to a distal end of the plunger to reciprocate the plunger.

3. A pump as defined in claim 1, wherein the plunger comprises a cylindrical, tubular plunger fitting inside the tubular housing and slightly smaller in diameter than the tubular housing, the plunger having an interior end connecting to a periphery of the piston, and wherein the entire hose coils inside the plunger and housing in said stowed configuration.

4. A pump as defined in claim 3, wherein the plunger has a distal end with holes, and further comprising a rod insertable through the holes to form a handle to actuate the plunger.

5. A pump as defined in claim 4, further comprising an end cap sealingly and removably engaging an end of the housing opposite the base to enclose the hose in the housing.

6. A pump as defined in claim 1, further comprising an end cap sealingly and removably engaging an end of the housing opposite the base to enclose the hose in the housing.

7. A pump as defined in claim 1, further comprising a foot support removably connected to the base of the housing to restrain motion of the housing in at least one direction as the plunger reciprocates.

8. A hand pump as defined in claim 7, further comprising at least one repair tool in the housing for repairing the deflated object and a removable handle placed in the housing and configured to connect to the plunger to reciprocate the plunger.

9. A hand pump as defined in claim 7, wherein the plunger comprises a tubular member smaller than and nested inside the housing and wherein the hose is within the plunger when stored.

10. A hand pump as defined in claim 7, wherein the handle, at least one tire repair tool and at least one of a tire patch or tire plug are placed inside the plunger.

11. A hand pump as defined in claim 7, further comprising a removable end cap disposed on the end of the housing opposite the base, and sealing the housing.

12. A hand pump and tire repair kit, as defined in claim 10, further comprising a removable end cap disposed on the end of the housing opposite the base, and sealing the housing.

13. A hand pump capable of providing a relatively large volume of compressed air, and having sufficient storage space for storing tools comprising:

a tubular, cylindrical housing into which is placed a sliding piston to compress air between the piston and a sealed end of the housing as the piston moves toward the sealed end of the housing, the housing having an opposing end, the piston having a seal interposed between the piston and the housing to seal the piston while compressing the air;

a plunger inside the housing and having an interior end connected to the sliding piston to reciprocate the piston in the housing and compress the air, the plunger having an opposing, distal end;

a hose having an interior end inside the housing and placed in fluid communication with the compressed air when the hose is in use, the hose having a distal end from which the compressed air exits, the hose being placeable entirely inside the housing during storage, said hose having sufficient physical memory that it re-coils after use;

a handle removably connected to the distal end of the plunger to actuate the plunger and pump the air; and an end cap removably connected to the distal end of the housing to enclose the housing with the hose inside the housing.

14. A hand pump as defined in claim 13, wherein the plunger comprises a tubular cylinder nested inside the housing and having aligned holes, and wherein the handle comprises a rod which extends through the aligned holes in the plunger to actuate the plunger.

15. A hand pump as defined in claim 13, further comprising tire repair items stored inside the plunger when the end cap is fastened to the housing.

* * * * *